US008272807B2

(12) United States Patent
Shaw et al.

(10) Patent No.: US 8,272,807 B2
(45) **Date of Patent: *Sep. 25, 2012**

(54) SURFACE DRAINAGE SYSTEM

(75) Inventors: Lee A. Shaw, Newport Beach, CA (US); Ronald D. Shaw, Corona Del Mar, CA (US)

(73) Assignee: Shaw & Sons, Inc., Costa Mesa, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/026,064

(22) Filed: Feb. 11, 2011

(65) Prior Publication Data

US 2011/0135384 A1 Jun. 9, 2011

Related U.S. Application Data

(63) Continuation of application No. 11/903,085, filed on Sep. 20, 2007, now Pat. No. 7,909,531.

(51) Int. Cl.
*E01C 11/22* (2006.01)
*E02B 11/00* (2006.01)

(52) U.S. Cl. ..... 404/2; 404/4; 405/36

(58) Field of Classification Search ..... 404/2, 3, 404/4, 5; 405/36, 39, 43; 210/170.03, 163
See application file for complete search history.

(56) References Cited

U.S. PATENT DOCUMENTS 469,044 A * 2/1892 Jungbluth ..... 119/450
3,815,213 A 6/1974 Evans et al.
3,898,778 A 8/1975 Erickson et al.
4,522,531 A 6/1985 Thomsen et al.
4,640,643 A 2/1987 Williams
4,648,739 A 3/1987 Thomsen
4,787,773 A 11/1988 Kehler
4,838,727 A 6/1989 Capuano
4,844,655 A 7/1989 Aleshire
5,380,121 A 1/1995 Schluter
5,564,857 A 10/1996 Schluter
5,971,662 A 10/1999 Becker et al.
6,000,881 A * 12/1999 Becker et al. ..... 405/119
6,746,179 B1 6/2004 Kerkhoff
6,905,285 B2 6/2005 Little et al.
7,105,086 B2 9/2006 Saliba
7,134,808 B2 * 11/2006 Albone et al. ..... 405/126
7,264,418 B1 * 9/2007 Houck ..... 405/43
7,507,054 B2 * 3/2009 Fithian et al. ..... 405/118
7,909,531 B2 3/2011 Shaw et al.
2004/0005194 A1 1/2004 Williams et al.
2007/0166105 A1 7/2007 Rzadkowolski

* cited by examiner

*Primary Examiner* — Thomas B Will
*Assistant Examiner* — Abigail A Risic
(74) *Attorney, Agent, or Firm* — Stetina Brunda Garred & Brucker

(57) ABSTRACT

A surface drainage structure formed above a subgrade may include an elongate drain conduit disposed partially within the subgrade. The elongate drain conduit may define at least one drain slot extending through a wall thereof. The structure may include a pavement layer with an exposed top surface and a drainage channel extending therefrom. The drainage channel may be in fluid communication with the drain slot of the elongate drain conduit. A method of forming the surface drainage structure includes placing the elongate drain conduit in the subgrade, forming the pavement layer, cutting an upper channel along the elongate drain conduit, and cutting a lower channel and the drain slot in the elongate conduit.

14 Claims, 4 Drawing Sheets

SURFACE DRAINAGE SYSTEM

CROSS-REFERENCE TO RELATED APPLICATIONS

The present application is a continuation of U.S. patent application Ser. No. 11/903,085 entitled SURFACE DRAINAGE SYSTEM filed Sep. 20, 2007 now U.S. Pat. No. 7,909,531.

STATEMENT RE: FEDERALLY SPONSORED RESEARCH/DEVELOPMENT

Not Applicable

BACKGROUND

1. Technical Field

The present invention relates generally to concrete structures and related construction methods, and more particularly, to surface drainage systems.

2. Background

Drainage systems are typically incorporated into paved streets, parking lots, airport runways, taxiways and ramps, driveways, and other like surfaces where surface water presents a substantial hazard. Such systems are configured to channel excess rain and ground water from the surface, and are typically comprised of conduits embedded beneath the surface to be drained. The conduit may form a part of a larger network of storm drains, which may transport water to a processing plant prior to discharge, directly discharge into a canal, river, lake, or the ocean, or discharge into small and localized dry wells.

Typically, conduits utilized in conventional surface drainage systems are elongate troughs with U-shaped or V-shaped cross sections. The conduits are disposed within the pavement in a manner that the open top is contiguous with the pavement surface. In order to facilitate gravitational flow, the pavement surface may be slightly sloped. It is understood that the conduits may be defined by the pavement material itself, such as where the pavement material is poured around a form that is later removed. The conduit thus corresponds to the shape of the form. Production of these types of conduits is expensive and time-consuming because of the need to install and remove the forms over extended periods of time. Alternatively, conduits may be stand-alone components constructed of metal, plastic, or other resilient material that are installed into the pavement. These open top conduits are difficult to install because they must be supported in a desired position while the pavement material is poured, particularly in such a position that the open top is flush with the pavement surface. To the extent that support members are utilized to maintain the desired position of the conduit, such components become permanently embedded within the pavement, thereby increasing costs.

Due to the wide open top of conventional drain conduits, grates are fitted thereon to prevent large debris from entering the conduit, to prevent injuries to pedestrians, and to prevent damage to vehicular traffic traveling over the conduit, while still allowing the excess surface water to pass. The grates are generally large and heavy because of the need to support the high load imposed by the traffic. As such, the grates tend to be unsightly and difficult to remove when the inside of the conduit needs to be cleaned. Along these lines, the grates often clog with debris that is likewise difficult to remove. Regardless of being able to support the load of vehicular traffic, the grates are hazardous to pedestrians, particularly to those wearing pointed-heel shoes or open-toe shoes. The heels may become wedged between the grates and cause the person to trip and fall. Or, a person's toes may also become trapped and likewise result in a fall, or worse, toe breakage.

As an alternative to using grates to cover the wide open tops of conventional drain conduits, slotted drains have been contemplated. Slotted drains generally consist of cylindrical pipes embedded beneath the surface, with relatively narrow slots or throats extending upwardly from the pipe to the surface. Thus, it is unnecessary to install a grate over the slots. Despite the small width of the slots, the conduit along which the water is carried to the outlet is large, so large volumes of water can be channeled away from the surface. Because of the specialized construction, slotted drains tend to be expensive. Due to the differences in the coefficient of thermal expansion between the slotted drains and the surrounding concrete, cracking of the concrete is a common problem. Especially problematic are parts of the paving that must conform to the diminutive subparts of the slotted drain, such as the throat and the lip of the opening. In environments where frequent freezing and thawing occur, this problem is further compounded. Furthermore, the above-described problems related to installation and particularly the problems of keeping the openings of the conduit flush with the pavement surface still remain. Support mechanisms added to alleviate the aforementioned problems further add to the cost of the slotted drains. In addition to the need for the surfaces surrounding the conduit openings/slots to be slanted, the conduit itself must be slanted to facilitate the flow of water. Accordingly, the difficulty associated with properly aligning the opening of the slotted drain with the pavement surface is multiplied.

Therefore, there is a need in the art for a surface drainage system that has minimal peripheral components such as throats, supports, and the like. There is also a need in the art for surface drainage systems that reduce dangers to pedestrians, and are visually attractive. There is also a need in the art for a method of constructing a surface drainage system that minimizes repeated alignment corrections, and generally simplifies the procedure.

BRIEF SUMMARY

In accordance with one embodiment of the present invention, there is provided a surface drainage structure formed above a subgrade. The structure may include an elongate drain conduit disposed partially within the subgrade. The elongate drain conduit may define at least one drain slot extending through a wall thereof. Further, the structure may include a pavement layer with an exposed top surface. The pavement layer may define a drainage channel extending from the top surface, and may further be in fluid communication with the drain slot of the elongate drain pipe.

According to another aspect of the present invention, there is provided a method of forming a surface drainage structure over a subgrade. The method may commence with forming a receiving trench in the subgrade, followed by placing an elongate conduit in the receiving trench. Thereafter, the method may continue with forming a pavement layer on the subgrade and over the elongate drain. After curing, the method may include cutting an upper channel into the pavement layer along the axis of the elongate drain. The upper channel may have a first depth. The method in accordance with one aspect of the present invention may conclude with cutting a first lower channel and a first drain slot in the elongate conduit. The first lower channel may extend from the first depth to the elongate drain conduit.

The present invention will be best understood by reference to the following detailed description when read in conjunction with the accompanying drawings.

BRIEF DESCRIPTION OF THE DRAWINGS

These and other features and advantages of the various embodiments disclosed herein will be better understood with respect to the following description and drawings, in which like numbers refer to like parts throughout, and in which.

Common reference numerals are used throughout the drawings and the detailed description to indicate the same elements.

DETAILED DESCRIPTION

The detailed description set forth below in connection with the appended drawings is intended as a description of the presently preferred embodiment of the invention, and is not intended to represent the only form in which the present invention may be constructed or utilized. It is understood that the use of relational terms such as first and second, top and bottom, and the like are used solely to distinguish one from another entity without necessarily requiring or implying any actual such relationship or order between such entities.

Figure 1:
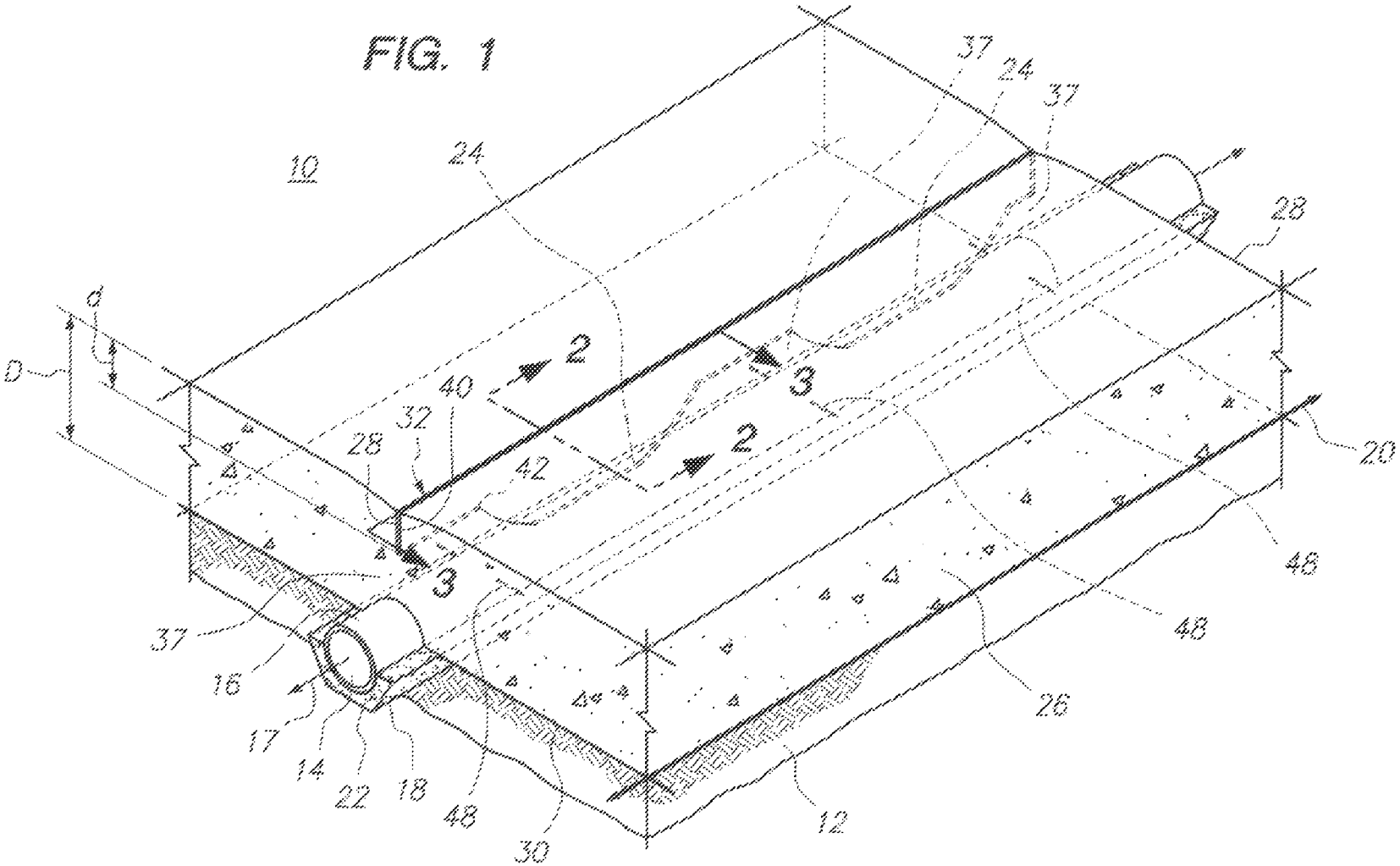
FIG. 1 is a perspective view of a surface drainage system in accordance with an aspect of the present invention including an elongate conduit disposed within a pavement layer.

With reference to FIG. 1, a surface drainage structure 10 in accordance with one aspect of the present invention is formed above a subgrade 12. The subgrade 12 generally refers to the foundation or the native ground underneath a pavement structure. Typically, the subgrade 12 is compacted to eliminate soft spots, with some of the topsoil and any vegetation present thereon being removed. The subgrade 12 may be stabilized with additional materials such as concrete, aggregate, and so forth.

Figure 3:
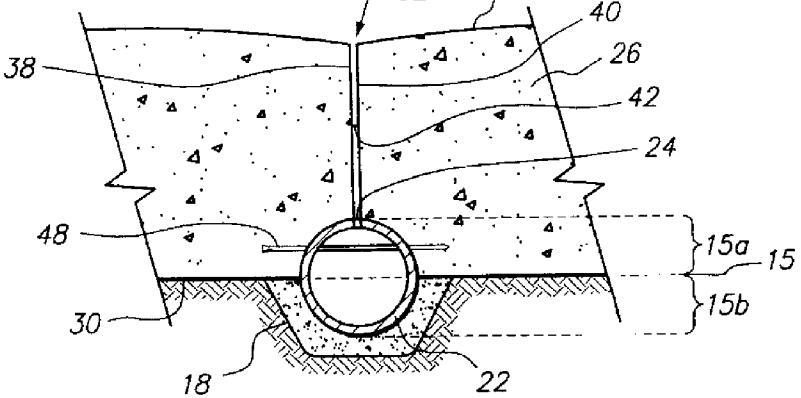
FIG. 3 is a cross-sectional view of the surface drainage system taken along axis 3-3 of FIG. 1.

With further reference to FIG. 3, the surface drainage structure 10 includes an elongate drain conduit 14 that is disposed partially within the subgrade 12. In one embodiment, the elongate drain conduit 14 is a pipe with a hollow cylindrical configuration having an upper half 15*a* and a lower half 15*b* separated by an intersecting plane 15. Further, the elongate drain conduit 14 is comprised of a conduit wall 16. The elongate drain conduit 14 has a longitudinal axis 17. The pipe may be constructed of any suitably resilient non-corrosive material such as acrylonitrile butadiene styrene (ABS) or polyvinyl chloride (PVC) plastics, though any other suitable material such as concrete, galvanized steel or copper may be readily substituted. As will be appreciated by one of ordinary skill in the art, ABS and PVC have desirable weather resistance characteristics, and retains its rigidness over a wide range of temperatures. It is understood that the thickness of the conduit wall 16 and the diameter of the elongate drain conduit 14 may be varied as well. Along these lines, the internal and external shapes of the elongate drain conduit 14 may be varied, and no particular shape, size, or material is deemed to be limiting. As a general matter, the diameter of the elongate drain conduit 14 should be large enough such that it is capable of handling a peak volume of water anticipated for a given application. For example, the diameter of the elongate drain conduit 14 in low precipitation areas may have smaller diameters, while in high precipitation areas the elongate drain conduit 14 may have larger diameters to accommodate a higher volume of water.

The subgrade 12 defines a trench 18, within which the elongate drain conduit 14 is placed. The trench 18 may be sloped relative to a ground axis 20, such that the elongate drain conduit 14 placed therein is likewise sloped. It is understood that such a sloped configuration facilitates the gravitational flow of rain water and the like upon entering the elongate conduit 14. The elongate drain conduit 14 is cast into position with a setting 22 disposed within, and along the entire length of, the trench 18. The setting 22 is molded at least partially around the elongate drain conduit 14. More specifically, in a preferred embodiment of the present invention, the setting 22 is molded around about the lower half 15*a* of the elongate drain conduit 14. The setting 18 may be either dry pack concrete or wet concrete, and one may be readily substituted for the other. As understood in the art, dry pack refers zero slump concrete that is tamped against a rigid mold until it is densely compacted, and compared to wet concrete, utilizes significantly less water. Alternatively, or in addition to the setting 18, the elongate drain conduit 14 may be held by various support members such as stakes and the like that are driven into the subgrade 12.

Figure 2:
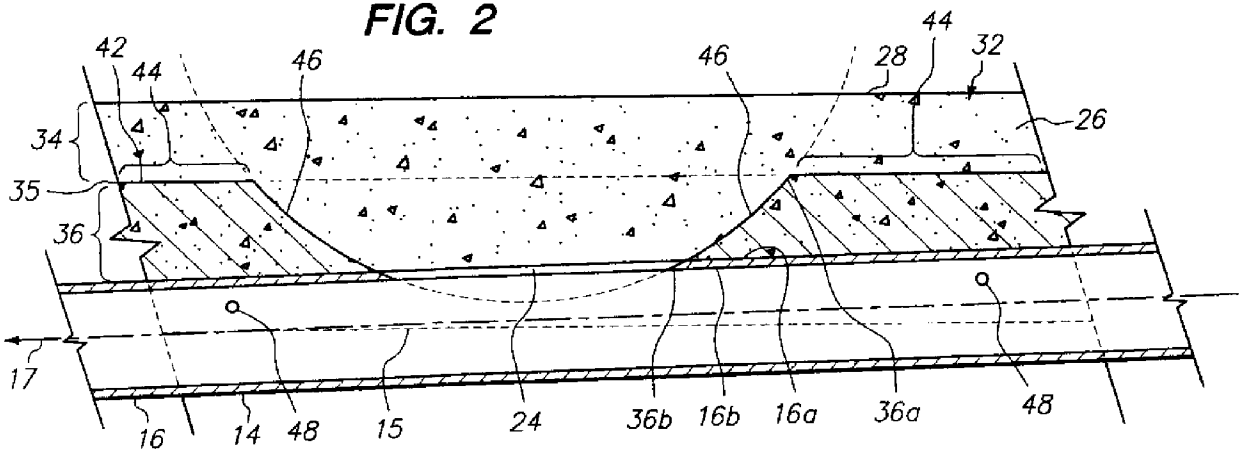
FIG. 2 is a cross-sectional view of the surface drainage system taken along axis 2-2 of FIG. 1.

With reference to FIGS. 1, 2, and 3, the elongate drain conduit 14 defines one or more drain slots 24 that extend through the conduit wall 16. More specifically, the upper half 15*a* of the elongate drain conduit 14 defines the drain slots 24, which are aligned with the longitudinal axis 17. According to one preferred embodiment, the drain slots 24 are formed in the conduit wall 16 such that it defines a perpendicular relationship between the intersecting plane 15. However, it will be appreciated by one of ordinary skill in the art that the drain slots 24 may be formed to define alternative angles with respect to the intersecting plane 15. It is understood that separate drain slots 24 are disposed along the elongate drain conduit 14 in a spaced relationship so as to prevent the same from collapsing under stress imparted to the pavement that is transferred to the elongate drain conduit 14, as well as under the weight of the pavement layer 26. In this regard, the structural integrity of the elongate conduit 14 is retained, and the drain slots 24 are prevented from closing shut. The width of the drain slots 24 may also be limited to further reduce incidences of stress-related damage to the elongate conduit 14, since the wider the drain slot 24, the weaker the elongate drain conduit 14.

In accordance with another aspect of the present invention, the surface drainage structure 10 includes a pavement layer 26. The pavement layer 26 defines an exposed top surface 28, and a bottom surface 30 that is adjacent to and is coterminous with the subgrade 12. It is understood that the pavement layer 26 is comprised of conventional concrete or asphalt concrete, though any other suitable pavement material may be readily substituted without departing from the scope of the present invention.

The pavement layer 26 also defines a drainage channel 32 that extends from the top surface 28, and is in fluid communication with the drain slot 24 of the elongate drain pipe 14. More particularly, according to one preferred embodiment of the present invention, the drainage channel 32 is defined by a first portion 34 that extends from the top surface 28 to a first depth d as delineated by a plateau line 35. Additionally, the drainage channel 32 is defined by a second portion 36 that extends from the first depth d to the elongate drain conduit 14. Generally, the depth d of the first portion 34 is approximately a third of a depth D of the pavement layer 26, though such dimensions may be varied. It is contemplated that the first portion 34 and the second portion 36 are contiguous, and collectively define the drainage channel 32. The width of the drainage channel 32 may be varied according to the needs of a particular application, and generally depends on the peak volume of water that is anticipated to be drained through the surface drainage structure 10. As indicated above, the drainage volume capabilities of the surface drainage structure 10 is related to the diameter of the elongate drain conduit 14. Accordingly, the width of the drainage channel 32 is matched such that the volume of water passing in the aggregate therethrough is substantially equivalent to the volume of water passing through the elongate drain conduit 14, in order to prevent flooding of the top surface 28. It will be appreciated by one of ordinary skill in the art that the width of the drainage channel 32 may be limited for the particular safety needs of a given application. For example, areas with anticipated high pedestrian traffic should have the width minimized to avoid injury. On the other hand, areas anticipated to have primarily vehicular traffic may have slightly larger widths because vehicle tires would be able to traverse the drainage channel 32 without the risk of becoming trapped, while there is a need for increased drainage capacity.

The first portion 34 extends substantially along the length of the elongate drain conduit 14 and is coplanar with the longitudinal axis 17, that is, the pavement layer 26 defines a slot that traverses the top surface 28. However, the first portion 34 need not extend the entire length of the surface drainage structure 10, and the drainage slot 24, particularly the first portion 34 thereof, may be segregated into different segments as desired. It will be appreciated that the first portion 34 serves as an initial entry point for water on the top surface 28. Along these lines, it is also contemplated that the top surface 28 is slanted towards the drainage channel 32, such that water flows thereto with gravitational force.

The second portion 36 is also coplanar with the longitudinal axis 17, and as indicated above, extends from the first depth d or plateau line 35 to the elongate drain conduit 14. It is understood that there may be one or more second portions 36, each of which are in a spaced relationship with respect to the others. The length l of the second portion 36 is less than the length of the first portion 34, which is typically the length of the entire pavement layer 26. The second portion 36 has a widened top end 36*a* adjacent to the first portion 34, and a narrowed bottom end 36*b* adjacent to the drain slot 24. The length of bottom end 36*b* is understood to be substantially equivalent to, and in alignment with, the drain slots 24. As indicated above, the drain slots 24 may be spaced to prevent the elongate drain conduit 14 from collapsing. It is for similar reasons that the second portion 36 of the drainage channel 32 does not extend the entire length of the surface drainage structure 10. Reinforcement segments 37 between the second portions 36 of the drainage channel 32 prevent the pavement layer 26 from collapsing and obstructing the flow of water therethrough.

Alternatively, the drainage channel 32 may be said to be defined by a left side surface 38, an opposed right side surface 40, and a channel surface 42. The channel surface 42 has a flat segment 44 that is parallel to the top surface 28, and an inclined segment 46. The inclined segment 46 connects the flat segment 44 to the conduit wall 16. According to one preferred embodiment of the present invention, the inclined segment 46 may have an arcuate shape, for reasons that will become more apparent below. However, it will be understood by one of ordinary skill in the art that any other suitable shape may be substituted, for example, a straight line. Along these lines, the segments of the conduit wall 16 that define the drain slots 24, i.e., that part of the conduit wall 16 between an outer surface 16*a* and an inner surface 16*b*, may be similarly arcuate in shape.

As explained above, the width of the drain slots 24 may be limited to strengthen the elongate drain conduit 14. To further improve the structural integrity of the elongate drain conduit 14, there is at least one support member 48 mounted transversely to the longitudinal axis 17. The support members 48 are anchored within the pavement layer 26, and thus extend into the same. More particularly, the support members 48 are inserted through the upper half 15*a* of the elongate drain conduit 14 and fixed to the conduit wall 16. According to one preferred embodiment shown in FIG. 1, the support members 48 may be screws or other like fasteners inserted through opposed sides of the elongate drain conduit 14 and extend into the interior of the same. Alternatively, as shown in FIG. 3, the support members 48 may be unitary structures that extend through the interior of the elongate drain conduit 14. It is contemplated that the support members 48 function to anchor the elongate drain conduit 14 in the pavement layer 26, as well as brace the elongate conduit 14 to increase resistance to the compressive forces imparted thereon. In this regard, larger width drain slots 24 may be utilized, increasing the water discharge capacity of the surface drainage structure 10.

Based on the description above, it will be understood that the surface drainage structure 10 collects water on the top surface 28, and channels it to a different location. More particularly, the top surface 28, with its slanted surface, directs water to the drainage channel 32. The first portion 34 serves as a collection basin, and in order to minimize the volume of standing water on the top surface 28 at any given point, it extends along the entire length of surface drainage structure 10. As water is collected in the first portion 34, the water is channeled into the second portion 36, which is in fluid communication with the elongate drain conduit 14 via the drain slots 24 formed thereon. It is understood that the elongate drain conduit 14 may be connected to other underground conduits such as larger storm drain pipes and the like. It is also contemplated that the drainage channel 32 be configured in such a manner so as to enhance the visual appearance of the surface drainage structure 10. More specifically, the elongate drain conduit 14 may be positioned in various geometric configurations, with corresponding drain channels 32 defining a desired pattern or design on the top surface 28.

Figure 4:
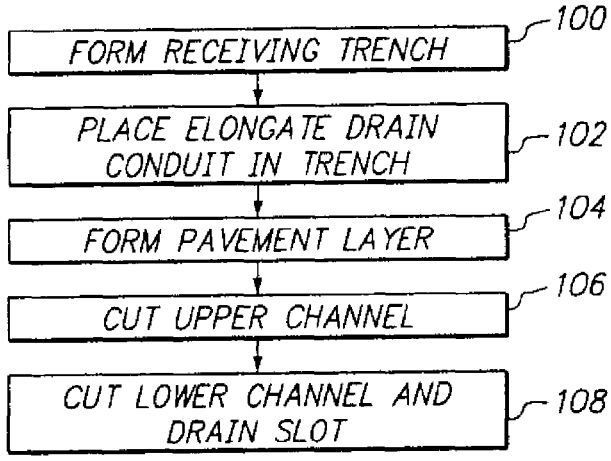
FIG. 4 is a flowchart depicting the method of constructing the surface drainage structure in accordance with an aspect of the present invention.
Figure 5A:
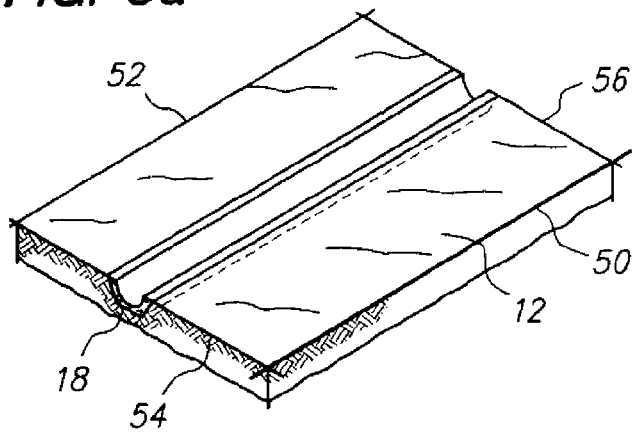
FIGS. 5*a*-5*e* are perspective views of the surface drainage systems in various stages of completion as per the method of constructing the surface drainage structure.

According to another aspect of the present invention, a method of forming the surface drainage structure 10 over the subgrade 12 is described in the flowchart of FIG. 4 and the sequential illustrations of the drainage structure 10 being formed as shown in FIGS. 5*a*-*e*. The method begins with the step 100 of forming the receiving trench 18, and otherwise preparing the subgrade 12 as explained above. As shown in FIG. 5*a*, the subgrade 12 has a quadrilateral configuration and is generally defined by a front side 50 and an opposed back side 52, and by a left side 54 and an opposed right side 56. The trench extends from the left side 54 to the right side 56, and has an axis that is substantially parallel to the front and back sides 50, 52. As explained briefly above, the receiving trench 18 has a semicircular cross section. As also explained above, the receiving trench 18 may be formed with a slant relative to the plane of the subgrade 12 to facilitate the flow of water.

Figure 5B:
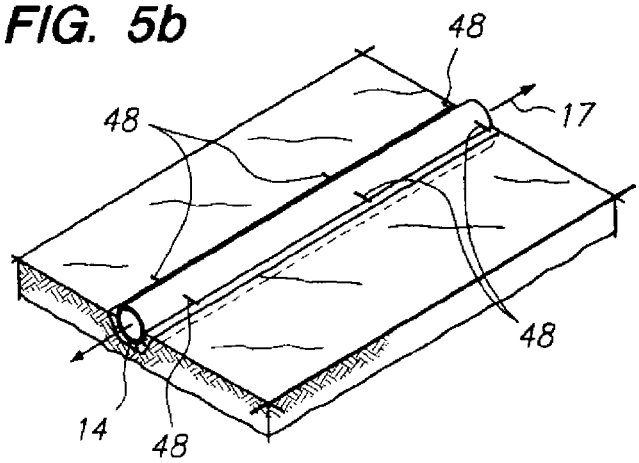

Thereafter, per step 102 and as shown in FIG. 5*b*, the method continues with placing the elongate drain conduit 14 in the receiving trench 18. The elongate drain conduit 14 is positioned such that the longitudinal axis 17 thereof is coaxial with the axis of the receiving trench 18. Optionally, the trench 18 may be partially filled with a setting material such as dry pack or wet concrete, with the elongate drain conduit 14 being held therein. Generally, the elongate drain conduit 14 is positioned at approximately three to four inches below the subgrade 12. As indicated above, the elongate drain conduit 14 may include the support members 48 that are mounted transversely thereto. Before the step 102 of placing the elongate drain conduit 14 in the trench 18, the elongate drain conduit 14 may be fitted with the support members 48. In accordance with one preferred embodiment, the support members 48 are not embedded within the subgrade 12. At this time, the elongate drain conduit 14 may be connected to additional conduits as described above.

Figure 5C:
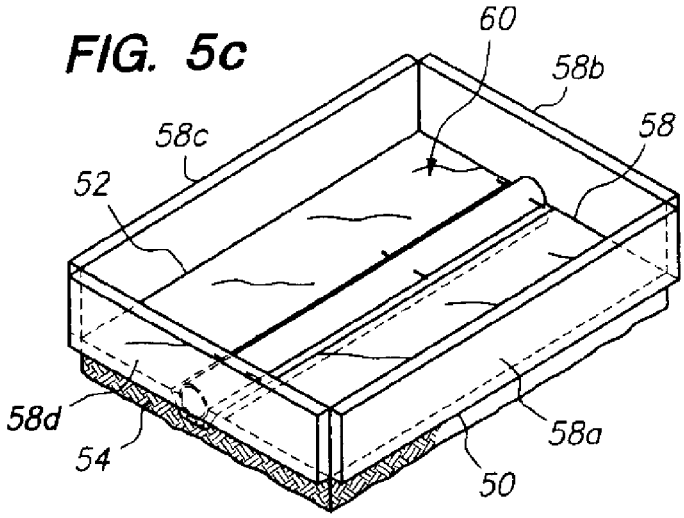

According to step 104 and as shown in FIG. 5*c*, the pavement layer 26 is formed on the subgrade 12 and over the elongate drain conduit 14. A series of forms 58*a-d* having a set depth are arranged in a quadrilateral configuration in alignment with the front side 50, the right side 56, the back side 52, and the left side 54, respectively, to define a structure space 60. The forms 58*a-d* are typically wooden beams having particular dimensions, and are anchored to the subgrade 12 via stakes and the like. In one preferred embodiment, the pavement layer 26 is comprised of concrete, so wet concrete is poured into the structure space 60. Upon curing the concrete, the forms 58*a-d* may be removed. Alternative pavement construction and finishing techniques are known in the art, however, and any such alternative may be readily substituted without departing from the scope of the present invention.

Figure 5D:
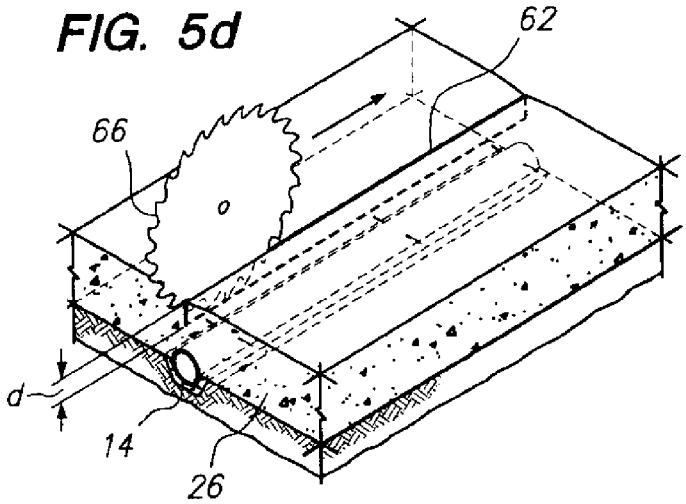

With reference to the partially completed surface drainage structure 10 shown in FIG. 5*d* and according to step 106, the method continues with cutting an upper channel 62 into the pavement layer 26. The upper channel 62, also referred to herein as the first portion 34 of the drainage channel 32, is cut along the longitudinal axis 17 to the first depth d. In order to determine the proper cut, a line is drawn or otherwise inscribed on the top surface 28 between the endpoints of the elongate drain conduit 14. As indicated above, the first depth d is approximately one-third the total depth D of the pavement layer 26. In a preferred embodiment of the present invention, a rotary saw 66 may be utilized, though any other type of saw may be substituted. As understood, the width of the drainage channel 32 is determined by the thickness of the blade of the rotary saw 66. It will be appreciated that the speed at which the rotary saw 66 is operated is dependent on the material of the elongate drain conduit 14, and one of ordinary skill in the art will be able to determine the proper speed based on the selected material.

Figure 5E:
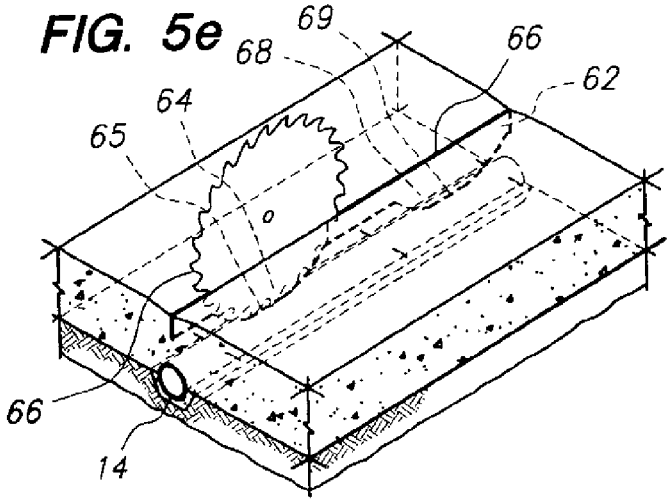

With reference to FIG. 5*e* and the flowchart of FIG. 3, the method may conclude with a step 108 of cutting a first lower channel 64 and a first drain slot 65 on the elongate drain conduit 14. The first lower channel 64, otherwise referred to herein as the second portion 36 of the drainage channel 32, extends from the first depth d to the elongate drain conduit 14. Preferably, the cutting in step 108 is accomplished with the rotary concrete saw 66. The saw 66 is ratcheted along the upper channel 62, to cut out the first lower channel 64 and to punch through the elongate conduit 14. In other words, the first lower channel 64 and the first drain slot 65 are vertically cut. As indicated above, with reference to FIG. 2, the inclined segment 46 in the second portion 36 or the lower channel 64 is arcuate, which is in conformance with the rotary saw 66. Along these lines, the width of the drain slot 24 and the drainage channel 32 is determined by the width of blade of the saw 66.

As understood, multiple lower channels 64 and drain slots 24 may be cut, each being spaced apart from the others. In further detail as illustrated in FIG. 5*e*, the method may also include the step of cutting a second lower channel 68 and a second drain slot 69 in the elongate drain conduit 14. The second lower channel 68 and the second drain slot 69 are in a spaced relation with respect to the first lower channel 64 and the first drain slot 65.

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

What is claimed is:

1. A surface drainage structure formed above a subgrade, comprising:

an elongate drain pipe defining a longitudinal axis, the pipe having a plurality of elongate drain slots wherein a lengthwise direction of the elongate drain slots is parallel to the longitudinal axis and extends through a wall of the pipe; and a pavement layer with an exposed top surface and the elongate drain pipe being at least partially disposed in the pavement layer, the pavement layer defining a drainage channel extending from the top surface and being in fluid communication with the plurality of elongate drain slots of the elongate cylindrical drain pipe, wherein the drainage channel is defined by opposed side surfaces and a channel surface, the channel surface having a flat segment extending in a parallel relation to the top surface, and opposed inclined segments connecting the flat segment to a wall of the elongate drain pipe.

2. The surface drainage structure of claim 1, wherein the drainage channel is defined by a first portion extending a first depth from the top surface and a second portion extending from the first depth to the elongate drain pipe, the second portion being contiguous with the first portion.

3. The surface drainage structure of claim 2, wherein the first portion of the drainage channel extends substantially along the length of the elongate drain pipe.

4. The surface drainage structure of claim 2, wherein the drainage channel is defined by a plurality of the second portions in a spaced relationship, the length of the second portion being less than the length of the first portion.

5. The surface drainage structure of claim 2, wherein the depth of the first portion of the drainage channel is approximately a third of the depth of the pavement layer.

6. The surface drainage structure of claim 1, wherein each of the inclined segments is arcuate.

7. The surface drainage structure of claim 1, further comprising at least one support member mounted transversely to a longitudinal axis of the elongate drain pipe, the support member extending into the pavement layer.

8. The surface drainage structure of claim 7, wherein the support member is inserted through the elongate drain pipe and extends into opposing portions of the pavement layer intersected by the longitudinal axis of the elongate drain pipe.

9. The surface drainage structure of claim 1 wherein the pipe is at least partially disposed within the subgrade.

10. The surface drainage structure of claim 9, wherein the pavement layer defines a bottom surface coterminous with the subgrade.

11. The surface drainage structure of claim 9, wherein the elongate drain pipe is disposed within the subgrade in a sloped configuration, thereby facilitating gravitational flow of fluid.

12. The surface drainage structure of claim 9, further comprising a setting disposed on the subgrade, the setting being molded at least partially around the elongate drain pipe.

13. The surface drainage structure of claim 12, wherein the setting is dry pack concrete.

14. The surface drainage structure of claim 12, wherein the setting is wet concrete.

* * * * *